US005419490A

United States Patent [19]

Testart et al.

[11] Patent Number: 5,419,490

[45] Date of Patent: May 30, 1995

[54] POINT RAIL FOR SWITCHING GEAR

[75] Inventors: Gérard Testart, Strasbourg; Claude Viou, Fere en Tardenois, both of France

[73] Assignee: Cogifer - Compagnie Generale d'Installations Ferroviaires, Croissy sur Seine, France

[21] Appl. No.: 144,040

[22] Filed: Nov. 1, 1993

[30] Foreign Application Priority Data

Nov. 16, 1992 [FR] France ..... 92 13753

[51] Int. Cl.[6] ..... E01B 5/14

[52] U.S. Cl. ..... 238/125; 238/148; 246/435 R

[58] Field of Search ..... 238/122, 125, 148, 149; 246/1 R, 435 R

[56] References Cited

U.S. PATENT DOCUMENTS

| | | | |
|---|---|---|---|
| 717,845 | 1/1903 | Haight | 238/125 |
| 1,790,556 | 1/1931 | Rendleman | 238/125 |
| 3,331,558 | 7/1967 | Broom | 238/148 |

FOREIGN PATENT DOCUMENTS

| | | | |
|---|---|---|---|
| 2297281 | 8/1976 | France . | |
| 2449161 | 9/1980 | France . | |
| 560327 | 10/1932 | Germany | 238/125 |
| 1113706 | 9/1961 | Germany . | |
| 2856850 | 7/1980 | Germany | 238/148 |
| 2904359 | 8/1980 | Germany . | |
| 233270 | 5/1925 | United Kingdom . | |

*Primary Examiner*—Robert J. Oberleitner
*Assistant Examiner*—S. Joseph Morano
*Attorney, Agent, or Firm*—Wenderoth, Lind & Ponack

[57] ABSTRACT

A point rail for switching gear comprises a head (10) with a running surface (Σ), a web (20) with a mid plane (π) and a base (30). The running surface (Σ) is inclined relative to this mid plane (π). The base (30) has two unequal wings (300), the larger of which is situated on the side towards which the running surface (Σ) is inclined. The center of gravity (G) is situated out of the mid plane (π) and placed on the side with the larger wing (300). The point rail has application to switching gears for long welded rail tracks on which very-high-speed trains run.

20 Claims, 5 Drawing Sheets

POINT RAIL FOR SWITCHING GEAR

BACKGROUND OF THE INVENTION

The subject of the invention is a point rail of the type comprising a head, a web and a base, used in railway switching gears and associated with a running track called the stock rail.

Such a point rail makes it possible to guide a railway vehicle as chosen either along, or branching from a route, by changing its position, either applied against the adjacent stock rail or separated from it, respectively.

Currently known point rails are of several types:

V—of a shape identical to the Vignoles rail R of the running track.

A—of a shape similar to the Vignoles rail with a thick web.

B—of a very squat shape with a very thick web which is asymmetric with respect to the head and includes a thick base which is asymmetric with respect to the head and with respect to the web.

C—of a shape similar to the Vignoles rail but of smaller height.

In order to bring together the bases of the point rail and the stock rail, point types of shapes V and A require removal by machining, both for the point rail and for the adjacent stock rail, of part of the base, which affects the stability and mechanical strength of both of the rails. Furthermore, the adjacent stock rail which, in the case of switching gears incorporated with long welded rails (LWR), is subjected to strong longitudinal stresses, takes on, by this machining, a tendency to buckle. Since the point rail and the stock rail are of the same height, and the base of the point rail is at least partially absent, it is unavoidably necessary to eliminate the inner fastening of the adjacent stock rail to the sleepers in this region. The continuity of transmission of the longitudinal, vertical and transverse forces to the sleepers and the track support is thereby impaired.

The type of profile with the shape B is of a short height, and consequently has weak resistance to the strong vertical forces. In order to be able to make a link with the running track rail, this profile must undergo difficult forging at its end, which requires, between the head and the base, a large surplus of material in order to overcome, during forging, the difference in height. The great asymmetry of the base and the web causes deformations during the cooling after rolling, and during the heat treatment. This requires demanding subsequent finishing operations.

The type of profile with the shape C, although eliminating some drawbacks of shapes V, A and B, proves to have insufficient horizontal and vertical strength and to be too flexible during switching operations. It generally suffers from a lack of material during forging. For this reason, the connection to the running track rail, instead of forging of the point rail, requires a reduction in the height of the running rail, which then localizes the welding for linking the two in a section of smaller height.

In the running track, the rail is positioned conventionally inclined inwards relative to the track in order to promote centering of the axle in conjunction with the conicity of the tire.

In order to avoid any discontinuity in running, especially in tracks for high-speed traffic, it is essential to retain this inclination of the rail in the switching gear.

The point rail, for reasons of deformation and forces during operation, must have the base positioned horizontally, which has the result, in the case of point rails of types V, A, B and C with their running surface horizontal, of providing the tire with a running surface which generates a discontinuity when crossing the point rail.

SUMMARY OF THE INVENTION

The object of the invention is to provide the profile of a point rail with characteristics which optimally satisfy the requirements of guidance, running, operation, stress and execution under load and speed conditions of present-day railways.

The subject of the invention is a point rail for switching gear comprising a head with a running surface, a web with a mid plane and a base. This point rail is noteworthy in that the running surface is inclined relative to this mid plane in that the base has two unequal wings, the larger of which is situated on the side towards which the running surface is inclined, and in that the center of gravity is situated out of the mid plane and placed at the side with the larger wing.

BRIEF DESCRIPTION OF THE DRAWINGS

Other characteristics of the invention will emerge on reading the description and claims which follow, as well as on examining the attached drawings which are given solely by way of example, and in which:

DETAILED DESCRIPTION OF THE PREFERRED EMBODIMENT

Since railway rails and, in particular, point rails are well known in the state of the art, only those points which directly or indirectly concern the invention will be described below. For the rest, a person skilled in the art of the technical sector in question will draw on the current conventional solutions at his disposal when facing the particular problems with which he is confronted.

In the rest of the description, the same reference number will always be used to identify a similar element, whatever the embodiment or its variant.

Figure 1A:
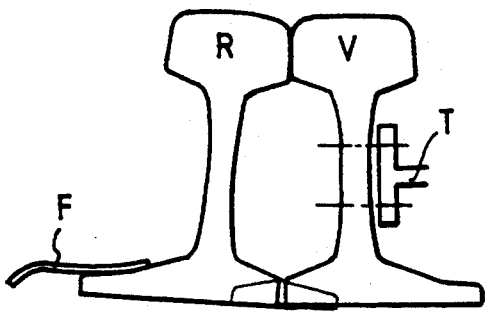
FIG. 1A PRIOR ART
FIGS. 1*a*–1D are diagrammatic views, in section, of existing point rails.
Figure 1B:
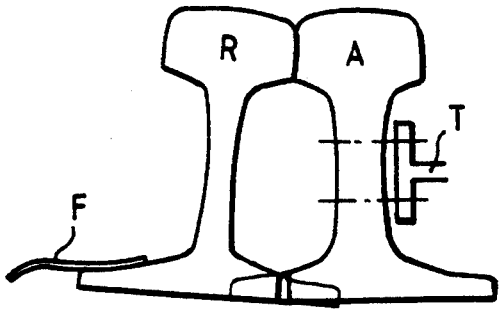
FIG. 1B PRIOR ART
Figure 1C:
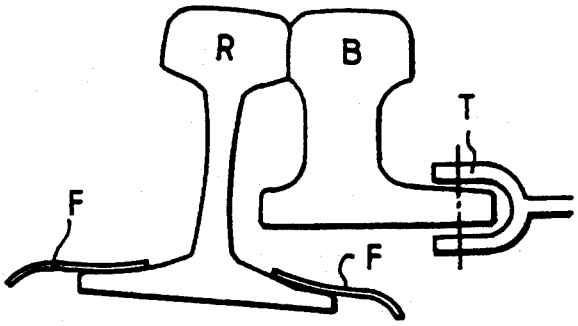
FIG. 1C PRIOR ART
Figure 1D:
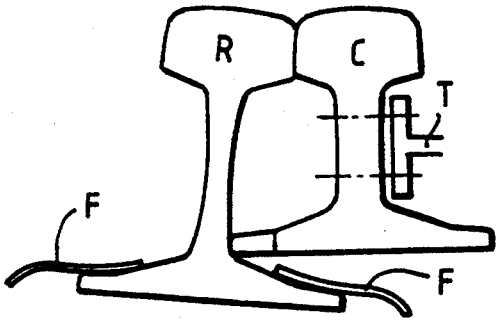
FIG. 1D PRIOR ART
Figure 2:
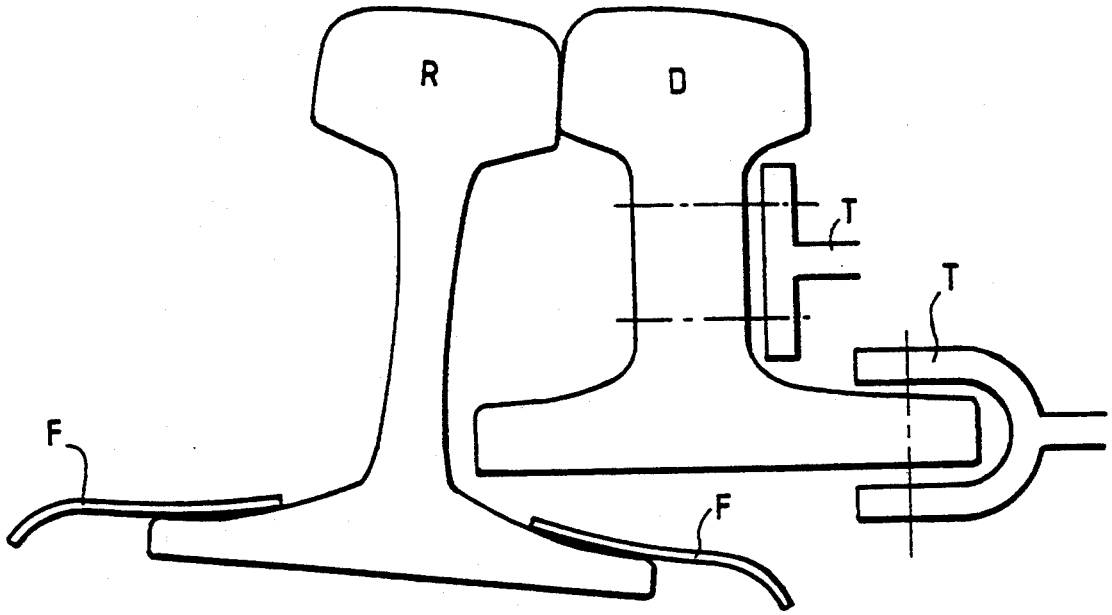
FIG. 2 is a similar view, on a larger scale, of the implementation of a point rail according to the invention.
Figure 3:
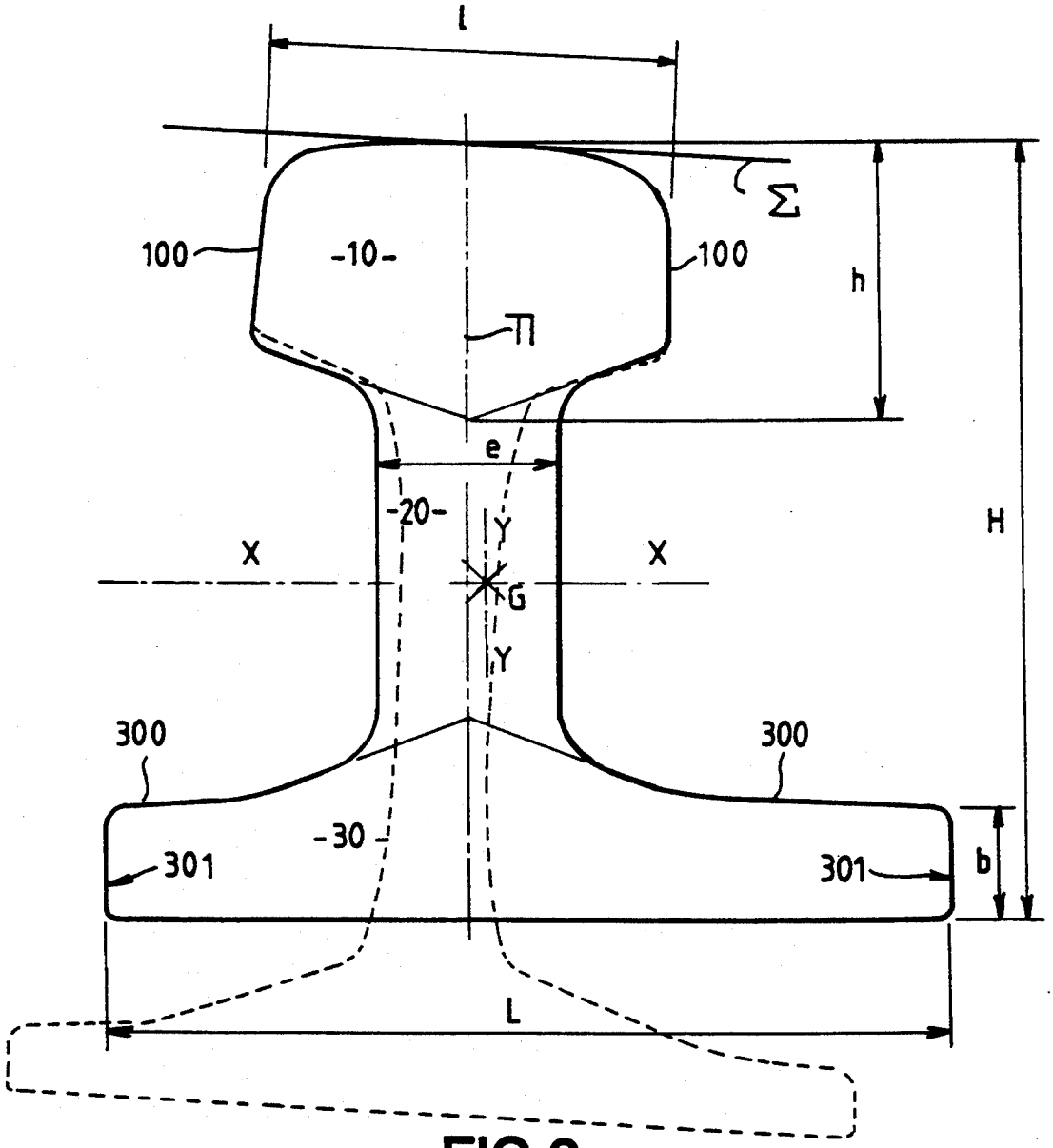
FIG. 3 is a sectional view of a point rail according to the invention drawn in solid lines in which the running track rail, drawn in broken lines, is also illustrated in the section.

As illustrated in FIG. 3, a point rail according to the invention comprises a head 10 with a running surface Σ, bordered by two flanks 100, a web 20 with a mid plane $\pi$ and a base 30 with wings 300 each having a longitudinal free edge 301.

FIG. 3 shows an example of the point rail according to the invention adapted to the running track rail UIC 60.

The running surface $\Sigma$ is inclined, preferably with a slope of 1/20, with respect to the mid plane $\pi$ of the web. The general shape of the head is produced in accordance with the recommendations of the UIC (International Union of Railways). As can be seen, one of the flanks of the head is parallel to the mid plane of the web, whilst the other of the flanks is inclined with a slope of preferably 1/10 relative to this plane. The width l of the head is approximately 72 mm and its height h is approximately 51.5 mm.

The web, with a thickness e of for example 32.5 mm, is dimensioned as a function of the requirement for material for forging at the height of the running track rail UIC 60.

The thickness b, for example 20 mm at the longitudinal free edge of the base, gives the profile the requisite resistance to vertical and horizontal stresses. The width of the large wing, measured from its longitudinal free edge to the mid plane, is approximately 85 mm, and the width of the small wing, measured in the same way, is approximately 65 mm. The asymmetric arrangement of the base, with a slope of for example 1/17 for the larger wing and a slope of for example 1/13 for the smaller wing, makes it possible to limit the machining of this base in the region where it is brought together with the stock rail.

The total height H of the point rail, for example 142 mm, leaves enough height free for fastening of the stock rail.

The width L of the base is approximately 150 mm.

It will be noted that the point rail according to the invention has a center of gravity G situated out of the mid plane of the web and placed on the side of the largest wing of the base.

A point rail according to the invention has a head of 3100 $mm^2$ and a base of 3780 $mm^2$, by way of indication.

By way of indication, the other properties of such a point rail are:

| | |
|---|---|
| Section: | 8894 $mm^2$ |
| Mass per unit length | 69.82 kg/m |
| Moment of inertia | 1x : 2025 $cm^4$ |
| | 1y : 764 $cm^4$ |
| Section modulus: | |
| with respect to the top | 250 $cm^3$ |
| with respect to the bottom | 331 $cm^3$ |
| transverse, running side | 94 $cm^3$ |
| transverse, outer side | 112 $cm^3$ |

Figure 4:
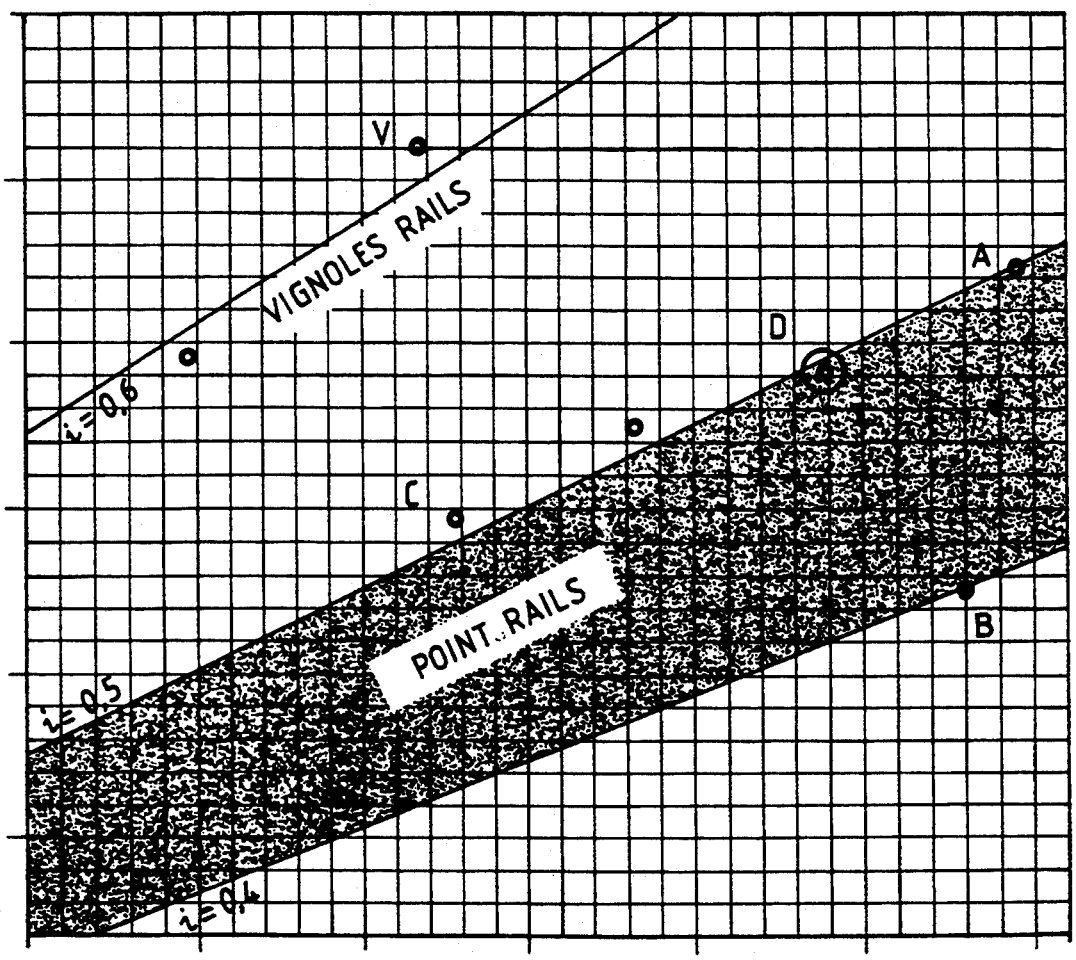
FIG. 4 is a graph illustrating the behaviour of the known traditional profiles A, B, C and R or V, and the profile D according to the invention, where the area of a profile is plotted on the abscissa and the area of the ellipse of inertia is plotted on the ordinate, with $$i = \frac{\text{area of the ellipse of inertia}}{\text{area of the profile}},$$

The performance of the various types of profiles are represented in the diagram of FIG. 4. The performance of the point rail according to the invention lies amongst the best of point rails already in existence.

Figure 5:
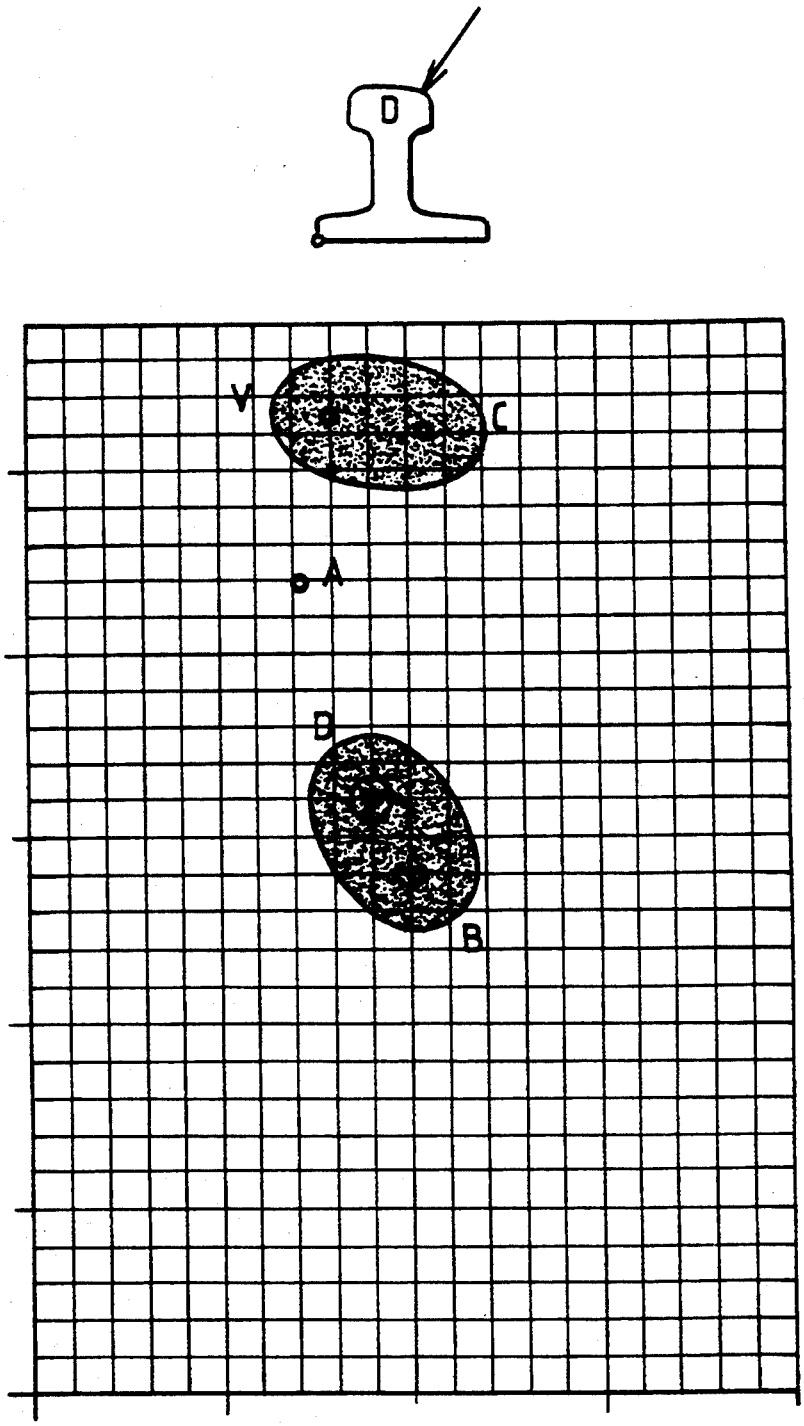
FIG. 5 is a diagram of the extreme stresses of the base under load as a curve, where the vertical stress is plotted on the abscissa and the horizontal stress on the ordinate.

The diagram in FIG. 5 shows that the stresses in the base of the point rail according to the invention are less than, or of the same level as, those of the bases of profiles of type A and B, which nevertheless have a weight per meter greater by 5 to 6%.

One feature of the point rail provided according to the invention results from the fact of rolling the head with a running surface inclined in correspondence with that of the running track rail in an inclined position.

Another feature of the point rail according to the invention results from the fact that it is given a maximum height with respect to the height of the running rail, whilst leaving the space necessary for the inner fastening F of this rail to the sleepers or the like.

Depending on the country, railway companies use different points safety and drive systems. The operating and control rods T engage with the point rail either at the base or in the web.

The general shape of the point rail provided according to the invention, has the possibility of fixing the operating and control rods in the web and/or to the base, depending on the network in which it is used.

The set of dimensions of the profile chosen for a point rail according to the invention leads to optimum balancing of the cost for producing the points and the guiding, support, strength and operating performances. Since the head of the point rail according to the invention is determined as a function of that of the running rail, the dimensions of the web and of the base in thickness and asymmetry allow good conditions for rolling, heat treatment and forging, as well as the best possible resistance to forces from traffic and operating requirements.

We claim:

1. A point rail, comprising a head having a running surface thereon, a base and a web connecting said head with said base, wherein said web has a mid plane, wherein said running surface is inclined relative to said mid plane, wherein said base has two wings of unequal size, the larger of said two wings being located on an inner side of said point rail, and said running surface being inclined towards the larger of said two wings, and wherein the center of gravity of said point rail is located offset from said mid plane in the direction of the larger of said two wings.

2. The point rail of claim 1, wherein said head has two flanks thereon, one of said flanks extending parallel to said mid plane and the other of said flanks being inclined relative to said mid plane.

3. The point rail of claim 2, wherein the other of said flanks is inclined with a slope of approximately 1/10.

4. The point rail of claim 2, wherein said two wings of said base have respective free longitudinal edges, and said base has the same thickness at each of said free longitudinal edges.

5. The point rail of claim 4, wherein the larger of said two wings of said base has a smaller slope than the smaller of said two wings.

6. The point-rail of claim 5, wherein the larger and the smaller of said two wings have slopes of approximately 1/17 and 1/13, respectively.

7. The point rail of claim 1, wherein said two wings of said base have respective free longitudinal edges, and said base has the same thickness at each of said free longitudinal edges.

8. The point rail of claim 7, wherein the larger of said two wings of said base has a smaller slope than the smaller of said two wings.

9. The point rail of claim 8, wherein the larger and the smaller of said two wings have slopes of approximately 1/17 and 1/13, respectively.

10. The point rail of claim 1, wherein said running surface has a slope of approximately 1/20.

11. A switching gear rail arrangement comprising:

a stock rail having a first head, a first base and a first web connecting said first head with said first base, wherein said first head has a first running surface thereon, said first running surface having a predetermined inclination; and a point rail adjacent to said stock rail comprising a second head having a second running surface thereon, a second base and a second web connecting said second head with said second base, wherein said second web has a mid plane, wherein said second running surface is inclined relative to said mid plane so as to correspond with said predetermined inclination of said first running surface, wherein said second base has two wings of unequal size, the larger of said two wings being located on an inner side of said point rail, and said second running surface being inclined towards the larger of said two wings, and wherein the center of gravity of said point rail is located offset from said mid plane in the direction of the larger of said two wings.

12. The switching gear rail arrangement of claim 11, wherein said second head has two flanks thereon, one of said flanks extending parallel to said mid plane and the other of said flanks being inclined relative to said mid plane.

13. The switching gear rail arrangement of claim 12, wherein the other of said flanks is inclined with a slope of approximately 1/10.

14. The switching gear rail arrangement of claim 12, wherein said two wings of said second base have respective free longitudinal edges, and said second base has the same thickness at each of said free longitudinal edges.

15. The switching gear rail arrangement of claim 14, wherein the larger of said two wings of said second base has a smaller slope than the smaller of said two wings.

16. The switching gear rail arrangement of claim 15, wherein the larger and the smaller of said two wings have slopes of approximately 1/17 and 1/13, respectively.

17. The switching gear rail arrangement of claim 11, wherein said two wings of said second base have respective free longitudinal edges, and said second base has the same thickness at each of said free longitudinal edges.

18. The switching gear rail arrangement of claim 17, wherein the larger of said two wings of said second base has a smaller slope than the smaller of said two wings.

19. The switching gear rail arrangement of claim 18, wherein the larger and the smaller of said two wings have slopes of approximately 1/17 and 1/13, respectively.

20. The switching gear rail arrangement of claim 11, wherein said running surface has a slope of approximately 1/20.

* * * * *